US006619810B2

(12) United States Patent
Kramer et al.

(10) Patent No.: US 6,619,810 B2
(45) Date of Patent: Sep. 16, 2003

(54) HALLOWEEN TREAT CARRIER INCLUDING GLOW-IN-THE-DARK MATERIAL, PUMPKIN DECORATING KIT, AND METHOD FOR DECORATING A PUMPKIN

(76) Inventors: Bruce Elliot Kramer, 9112 Cherbourg Dr., Potomac, MD (US) 20854; Joy Elizabeth Belin, 9112 Cherbourg Dr., Potomac, MD (US) 20854

( * ) Notice: Subject to any disclaimer, the term of this patent is extended or adjusted under 35 U.S.C. 154(b) by 0 days.

(21) Appl. No.: 09/750,362

(22) Filed: Dec. 29, 2000

(65) Prior Publication Data

US 2002/0085369 A1 Jul. 4, 2002

(51) Int. Cl.[7] ..... F21V 9/16
(52) U.S. Cl. ..... 362/84; 362/156
(58) Field of Search ..... 362/84, 154, 156, 362/186, 363, 124

(56) References Cited

U.S. PATENT DOCUMENTS

| | | | | |
|---|---|---|---|---|
| 2,428,133 A | | 9/1947 | Yogan | |
| 4,802,071 A | | 1/1989 | Schuster | |
| 4,926,296 A | * | 5/1990 | Blume et al. | 362/156 |
| 5,091,833 A | | 2/1992 | Paniaguas et al. | |
| 5,567,054 A | * | 10/1996 | Dalgleish | 383/10 |
| 5,597,230 A | | 1/1997 | Newman | |
| 5,984,754 A | * | 11/1999 | Freelander | 446/73 |
| 6,059,423 A | * | 5/2000 | Knopick | 362/156 |
| 6,186,635 B1 | * | 2/2001 | Peterson et al. | 362/84 |
| 6,431,724 B1 | * | 8/2002 | Tedham et al. | 362/154 |

OTHER PUBLICATIONS

"Glow–in–the–Dark Tree Masks", manufactured by Sun Hill Industries, Inc., Stanford, CT (1997).

"12 Puffy Stickers", manufactured by Fun World, Carle Place, NY (2000 or earlier) Date?? None on Packaging.

"12 Glow Decorations", manufactured by Fun World, Carle Place, NY (2000 or earlier) Date??–None on Packaging.

"Light at Nite® Reflective Stickers", manufactured by S & J Marketing and Merchandising, Brooklyn, NY (1988).

"Pumpkin Stickers Decorating Kit", manufactured by Amscan, Inc., Harrison, NY (2000 or earlier) Date??None on Packaging.

"Cosmic Sparklers", manufactured by DaMert Company, Berkeley, CA (1998).

Long & Foster Advertisement for "Free Safety–Reflective Trick–or–Treat Bag" *Washington Post* Classified Section, P; Sunday, Oct. 28, 2001.

"Glow in the Dark Stickers," ©Hallmark Cards, USA (No Date Shown on Packaging).

* cited by examiner

*Primary Examiner*—Sandra O'Shea
*Assistant Examiner*—Ronald E. DelGizzi

(57) ABSTRACT

A Halloween treat carrier includes a container having thereon a Halloween design, wherein the Halloween treat carrier includes a glow-in-the-dark material. A pumpkin decorating kit includes (A) a base material containing a glow-in-the-dark material and having a back surface and a front surface, (B) an adhesive layer on the back surface of the base material for adhering the base material to a pumpkin, and (C) a release material to which the base material is attached via the adhesive layer and from which the base material together with the adhesive layer can be released upon use, wherein the front surface of the base material containing glow-in-the-dark material can provide a jack-o'-lantern appearance on the pumpkin. A method for decorating a pumpkin includes providing a jack-o'-lantern appearance with a base material containing glow-in-the-dark material and having an adhesive thereon, and adhering the base material containing glow-in-the-dark material to a pumpkin via the adhesive.

21 Claims, 2 Drawing Sheets

HALLOWEEN TREAT CARRIER INCLUDING GLOW-IN-THE-DARK MATERIAL, PUMPKIN DECORATING KIT, AND METHOD FOR DECORATING A PUMPKIN

FIELD OF THE INVENTION

The present invention relates to illuminated Halloween articles. More specifically, the present invention relates to particular Halloween articles which are illuminated with glow-in-the-dark material.

BACKGROUND OF THE INVENTION

Illuminated articles have been made in the past for use during Halloween for purposes of fun and safety.

As an example of an illuminated article made for the purpose of fun, a jack-o'-lantern has been made by cleaning out the soft pulp of a pumpkin, carving openings corresponding to eyes, a nose, and a mouth into the pumpkin, and placing a burning candle into the pumpkin to illuminate the openings. However, such a jack-o'-lantern involves carving with a knife and lighting a candle, which can be dangerous activities, and the carving process can also be messy. Also, if the person carving the pumpkin is dissatisfied with the appearance of the jack-o'-lantern after it is carved, it may be difficult or impossible to improve the appearance.

Patents such as U.S. Pat. No. 2,428,133 disclose artificial pumpkin jack-o'-lanterns which have pumpkin face electric lights to replace the candles of previous jack-o'-lanterns. However, such artificial jack-o'-lanterns do not provide the feeling of authenticity which comes from using a real pumpkin, and they have a fixed appearance which does not allow one to personalize the jack-o'-lantern. Also, such artificial jack-o'-lanterns are more complex than necessary, involving light bulbs and the like.

U.S. Pat. No. 5,091,833 discloses a kit for creating a jack-o'-lantern with a plurality of illuminating units, each of which has a battery and a light bulb. While this kit allows one to customize the jack-o'-lantern, it is quite complex, involving batteries, light bulbs, and the like.

Accordingly, there is a need in the art for a simple and safe way to obtain a jack-o'-lantern.

As an example of an illuminated article made for the purpose of safety, U.S. Pat. No. 4,802,071 discloses a lantern candy carrier which is illuminated by battery power to improve a child's ability to see and/or be seen at night. U.S. Pat. No. 4,926,296 describes an illuminated carrying bag containing a power source which energizes light bulbs that shine light for safety and decorative purposes. U.S. Pat. No. 5,597,230 discloses an ornamental carrier with flashlight-type eyes that offers both increased safety and enjoyment for a child. U.S. Pat. No. 6,059,423 discloses a decoratively illuminated carrying device which has lights positioned in a decorative pattern about a bag to provide increased safety and improve a child's ability to see and be seen.

However, these illuminated articles made for the purpose of safety are quite complex, involving light bulbs, batteries, and the like.

Accordingly, there is a need in the art for a simple and safe Halloween treat carrier.

SUMMARY OF THE INVENTION

Thus, one object of the present invention is to provide particular illuminated Halloween articles which are fun and safe.

Another object of the present invention is to provide such illuminated Halloween articles which are simple in design.

These and other objects are satisfied by the present invention, which includes various embodiments that achieve one or more of the objects.

One embodiment of the present invention provides a Halloween treat carrier including a container having thereon a Halloween design, wherein the Halloween treat carrier includes a glow-in-the-dark material.

Another embodiment of the present invention provides a pumpkin decorating kit including (A) a base material containing a glow-in-the-dark material and having a back surface and a front surface, (B) an adhesive layer on the back surface of the base material for adhering the base material to a pumpkin, and (C) a release material to which the base material is attached via the adhesive layer and from which the base material together with the adhesive layer can be released upon use, wherein the front surface of the base material containing glow-in-the-dark material can provide a jack-o'-lantern appearance on the pumpkin.

Still another embodiment of the present invention provides a method for decorating a pumpkin, including providing a pumpkin decorating kit including (A) a base material containing a glow-in-the-dark material and having a back surface and a front surface, (B) an adhesive layer on the back surface of the base material for adhering the base material to a pumpkin, and (C) a release material to which the base material is attached via the adhesive layer and from which the base material together with the adhesive layer can be released upon use, wherein the front surface of the base material containing glow-in-the-dark material can provide a jack-o'-lantern appearance on the pumpkin, peeling pieces of the base material having adhesive thereon from the release material, wherein the pieces are constituent elements of a jack-o'-lantern appearance, and adhering the pieces to a pumpkin to provide a jack-o'-lantern appearance on the pumpkin.

DESCRIPTION OF THE INVENTION

Figure 1:
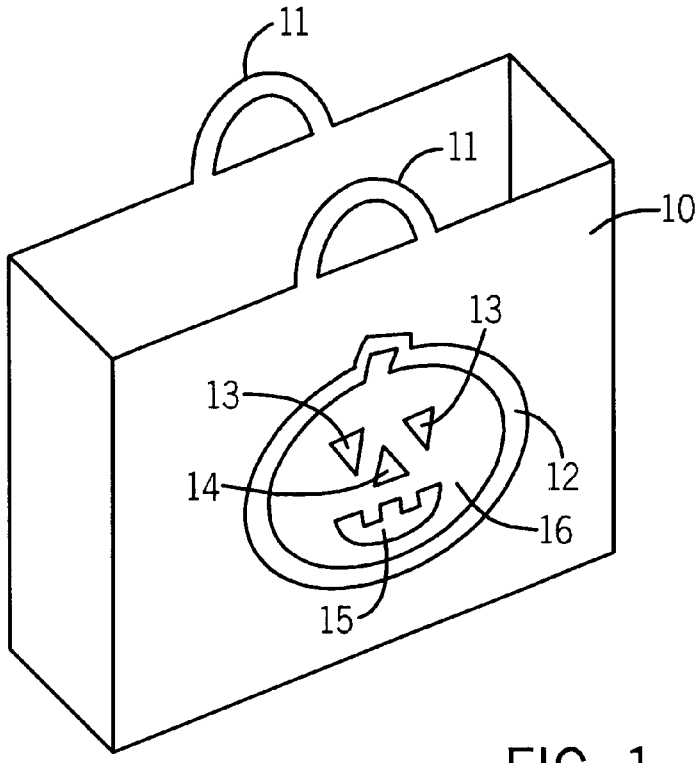
FIG. 1 shows an embodiment of the Halloween treat carrier of the present invention.

The container for the Halloween treat carrier of the present invention can be, for example, a bag, a hollow plastic pumpkin, or a pail. The bag can be a paper bag or a plastic bag. The container preferably has at least one handle. The handle(s) can be integral to the container. That is, the handle(s) and the section of the container for containing the treats can all be part of a one-piece container (e.g., in the case of a plastic bag). Alternatively, the handle(s) can be separate from the section of the container for containing the treats, with the handle(s) and the section of the container for containing the treats being fastened to each other (e.g., with an adhesive tape). This alternate embodiment could be used in the case of, e.g., a paper bag, a plastic bag, or a hollow plastic pumpkin.

The container has thereon a Halloween design. Preferably, the design is a jack-o'-lantern (e.g., in the case where the container is a bag) or the eyes, mouth (or simply teeth), and optionally nose of a jack-o'-lantern (e.g., in the case where the container is a bag or a hollow plastic pumpkin). However, the design can be any other design suitable for Halloween. For example, the design can be a ghost, a bat, a cat, or a spider.

The Halloween design can be integral to the container or affixed thereto. When the Halloween design is integral to the container, it is part of the container itself. For example, in the case where the container is a plastic bag, the Halloween design is embedded in the plastic. When the Halloween design is affixed to the container, it is separate from the container and is affixed via, e.g., an adhesive or a plastic tab or snap. The adhesive can be any suitable adhesive in the art, e.g., an acrylic adhesive. It is possible for the Halloween design to be painted on the container. As one example of a case where there is a Halloween design on a plastic material, mention can be made of the product "Glow-in-the-Dark Tree Masks" by Sun Hill Industries, Inc., Stamford, Conn. As an example of a case where a Halloween design can be affixed via an adhesive, mention can be made of the products "12 Puffy Stickers" and "12 Glow Decorations" by Fun World, Carle Place, N.Y.

In one embodiment of the present invention, the Halloween design includes the glow-in-the-dark material. In another embodiment of the present invention, the container includes the glow-in-the-dark material. In still another embodiment of the present invention, the container includes one glow-in-the-dark material, and the Halloween design includes a different color glow-in-the-dark material.

The glow-in-the-dark material could be one used presently in Halloween products such as the aforementioned "12 Puffy Stickers" and "12 Glow Decorations" by Fun World. Glow-in-the-dark materials which might be used in the present invention include those disclosed in U.S. Pat. Nos. 5,229,531, 5,839,718, 5,951,915, 6,005,024, and 6,123,871, the disclosures of which are incorporated herein by reference. It is possible for the glow-in-the-dark material to be an ink or a paint.

For added illumination, reflective material can also be present in (e.g., as in the case of an ink permeating into the material) or on (e.g., adhered or sewn on) the container. The reflective material can be used in conjunction with the aforementioned Halloween design (e.g., as a border around the design or as constituent parts, such as the eyes, nose and mouth) or separately from it.

The reflective material could be one used presently in Halloween products such as LITE AT NITE™ by S & J Marketing and Merchandising, Brooklyn, N.Y. The reflective material could be a SCOTCHLITE™ reflective material by the 3M Company, St. Paul, Minn. Possible colors of the reflective material include silver, fluorescent red-orange, and fluorescent lime yellow. U.S. Pat. Nos. 4,182,548, 4,651,447, 5,402,266, and 5,837,347 include disclosure of reflective materials and are incorporated herein by reference.

In the pumpkin decorating kit, the base material is a material that can contain a glow-in-the-dark material. As one example, the base material can be paper. As another example, the base material can be a polymeric material.

The base material can include eyes, a mouth and optionally a nose which are cut out so that they can be peeled off of a release material and stuck onto a pumpkin. As an alternative, a user can cut eyes, a mouth and optionally a nose from the base material so that the jack-o'-lantern appearance can be custom designed by the user.

As with the glow-in-the-dark material associated with the treat carrier, the glow-in-the-dark material associated with the pumpkin decorating kit could be one used presently in Halloween products such as the aforementioned "12 Puffy Stickers" and "12 Glow Decorations" by Fun World. Again, glow-in-the-dark materials which might be used in the present invention include those disclosed in U.S. Pat. Nos. 5,229,531, 5,839,718, 5,951,915, 6,005,024, and 6,123,871, the disclosures of which are incorporated herein by reference, and it is possible for the glow-in-the-dark material to be an ink or a paint.

The adhesive layer in the pumpkin decorating kit is located on the back surface of the base material. The adhesive layer should comprise an adhesive capable of adhering the base material to a pumpkin. The adhesive can be one conventionally used in the sticker art. For example, the adhesive can be the one used in "Pumpkin Stickers Decorating Kit" by Amscan, Inc., Harrison, N.Y. It is contemplated that the adhesive could be, e.g., a pressure-sensitive adhesive such as an acrylic adhesive. Adhesive compositions such as those described in U.S. Pat. No. 6,136,903, the disclosure of which is incorporated herein by reference, can suitably be used in the present invention.

The release material in the pumpkin decorating kit serves as a substrate on which the base material together with the adhesive layer can be held until the kit is used. The release layer should comprise a material capable of releasing the base material together with the adhesive layer upon peeling action. The release layer can be one conventionally used in the sticker art. For example, the release layer can be the one used in "Pumpkin Stickers Decorating Kit" by Amscan, Inc. It is contemplated that the release layer could be a silicone-based release layer.

Further sticker design details which can suitably be used in the present invention can be found in patents such as U.S. Pat. No. 6,150,035, the disclosure of which is incorporated herein by reference.

Thus, the present invention provides glow-in-the-dark stickers in the form of eyes, a mouth, and optionally a nose of a jack-o'-lantern to be applied to a pumpkin.

Still another embodiment of the present invention provides a method for decorating a pumpkin, including providing a pumpkin decorating kit including (A) a base material containing a glow-in-the-dark material and having a back surface and a front surface, (B) an adhesive layer on the back surface of the base material for adhering the base material to a pumpkin, and (C) a release material to which the base material is attached via the adhesive layer and from which the base material together with the adhesive layer can be released upon use, wherein the front surface of the base material containing glow-in-the-dark material can provide a jack-o'-lantern appearance on the pumpkin, peeling pieces of the base material having adhesive thereon from the release material, wherein the pieces are constituent elements of a jack-o'-lantern appearance, and adhering the pieces to a pumpkin to provide a jack-o'-lantern appearance on the pumpkin.

In this embodiment, the constituent elements of a jack-o'-lantern can be eyes, a mouth, and optionally a nose. These constituent elements can be pre-cut pieces of the base material, or they can be pieces which are cut out from an overall sheet of base material by a user of the pumpkin decorating kit carrying out the method of the present invention.

The invention products containing glow-in-the-dark material are used by placing the products in sunlight or artificial light for a sufficient amount of time such that the material will glow for a desired length of time when it is placed in the dark. The amount of time in which a product is placed in sunlight or artificial light will depend on the particular glow-in-the-dark material that is used. Once the product has been in the sunlight or artificial light for a sufficient amount of time, it can be used in the dark. For example, the invention treat carrier can be carried by a child in the dark. Also, the pumpkin decorating kit can be used to provide pieces of plastic material containing glow-in-the-dark material in the form of eyes, a mouth, and optionally a nose, which can then be adhered to a pumpkin to create a jack-o'-lantern that glows in a dark room or outside in the dark.

The present invention will now be described by way of reference to the Figures, but it should not be construed as being limited thereto.

FIG. 1 shows one embodiment of the Halloween treat carrier of the present invention. The treat carrier includes a bag 10 having handles 11 and a Halloween design including a border 12, eyes 13, nose 14, and mouth 15 of reflective material, with the balance of the jack-o'-lantern 16 being made of glow-in-the-dark material.

Figure 2:
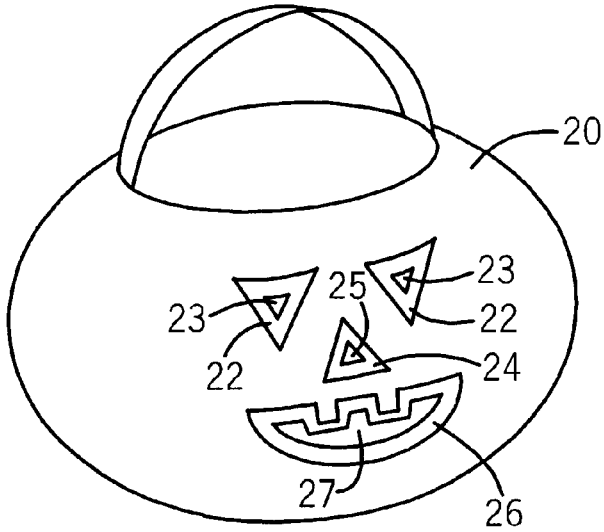
FIG. 2 shows another embodiment of the Halloween treat carrier of the present invention.

FIG. 2 shows a second embodiment of the Halloween treat carrier of the present invention. The treat carrier includes a hollow plastic pumpkin 20 having a handle 21 and a Halloween design including eye borders 22, nose border 24, and mouth border 26 of reflective material and eyes 23, nose 25, and mouth 27 of glow-in-the-dark material.

Figure 3:
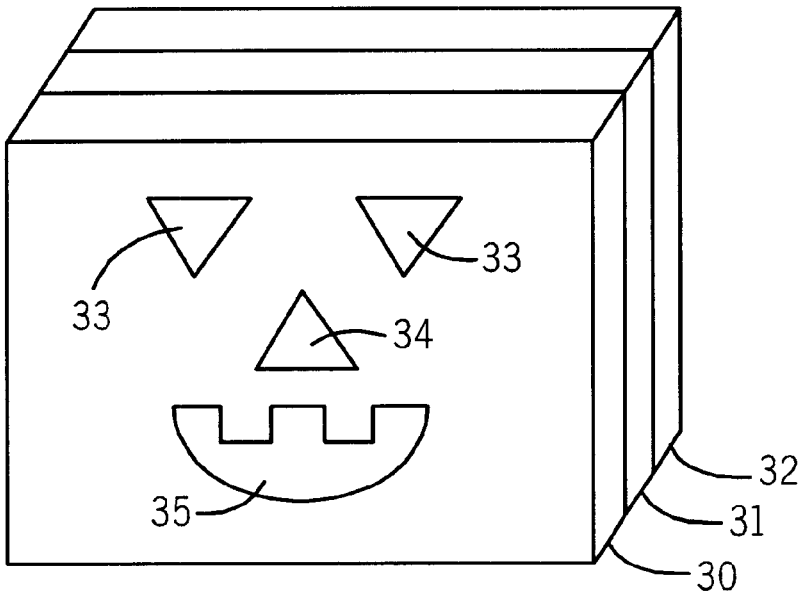
FIG. 3 shows an embodiment of the pumpkin decorating kit of the present invention.

FIG. 3 shows an embodiment of the pumpkin decorating kit of the present invention. The kit includes a base material 30, an adhesive layer 31, and a release layer 32, with the base material containing eyes 33, nose 34, and mouth 35 made of glow-in-the-dark material.

Figure 4:
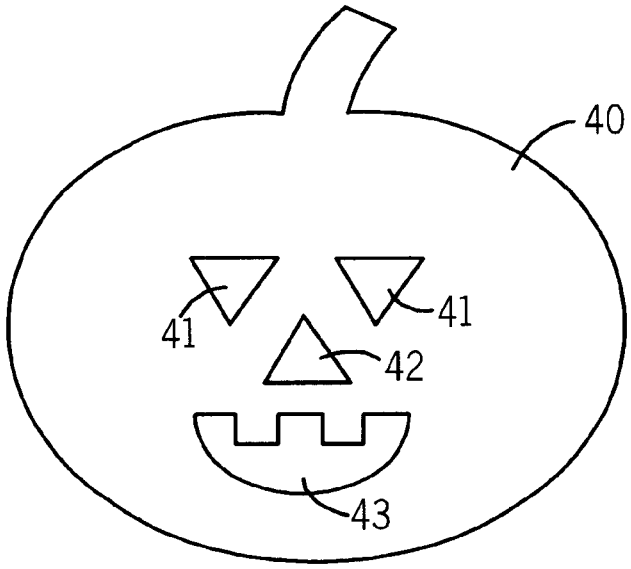
FIG. 4 shows a pumpkin decorated by using the pumpkin decorating kit of the present invention.

FIG. 4 shows a pumpkin decorated by using the pumpkin decorating kit of the present invention. The decorated pumpkin includes a pumpkin 40 having adhered thereon eyes 41, nose 42, and mouth 43 made of glow-in-the-dark material.

While the invention has been described in detail and with reference to specific embodiments thereof, it will be apparent to one of ordinary skill in the art that various changes and modifications can be made therein without departing from the spirit and scope thereof.

What is claimed is:

1. A Halloween treat carrier comprising a container having thereon a Halloween design, wherein the container and/or the Halloween design comprises a glow-in-the-dark material.

2. A Halloween treat carrier as claimed in claim 1, wherein the Halloween design comprises the glow-in-the-dark material.

3. A Halloween treat carrier as claimed in claim 1, wherein the container comprises the glow-in-the-dark material.

4. A Halloween treat carrier as claimed in claim 1, wherein the Halloween design comprises a reflective material.

5. A Halloween treat carrier as claimed in claim 2, wherein the Halloween design further comprises a reflective material.

6. A Halloween treat carrier as claimed in claim 3, wherein the Halloween design comprises a reflective material.

7. A pumpkin decorating kit comprising (A) a base material containing a glow-in-the-dark material and having a back surface and a front surface, (B) an adhesive layer on the back surface of the base material for adhering the base material to a pumpkin, and (C) a release material to which the base material is attached via the adhesive layer and from which the base material together with the adhesive layer can be released upon use, wherein the front surface of the base material containing glow-in-the-dark material can provide a jack-o'-lantern appearance on the pumpkin.

8. A pumpkin decorating kit as claimed in claim 7, wherein the base material comprises at least eyes and a mouth which are cut out so that they can be peeled off of the release material and stuck onto a pumpkin to provide a jack-o'-lantern appearance.

9. A pumpkin decorating kit as claimed in claim 7, wherein the base material can be cut by a user of the kit to form at least eyes and a mouth that can be peeled off of the release material and stuck onto a pumpkin to provide a jack-o'-lantern appearance.

10. A pumpkin decorating kit as claimed in claim 7, wherein the base material comprises paper.

11. A pumpkin decorating kit as claimed in claim 7, wherein the base material comprises a polymeric material.

12. A pumpkin decorating kit as claimed in claim 8, wherein the base material comprises paper.

13. A pumpkin decorating kit as claimed in claim 8, wherein the base material comprises a polymeric material.

14. A pumpkin decorating kit as claimed in claim 9, wherein the base material comprises paper.

15. A pumpkin decorating kit as claimed in claim 9, wherein the base material comprises a polymeric material.

16. A method for decorating a pumpkin, comprising providing a pumpkin decorating kit as claimed in claim 7, peeling pieces of the base material having adhesive thereon from the release material, wherein the pieces are constituent elements of a jack-o'-lantern appearance, and adhering the pieces to a pumpkin to provide a jack-o'-lantern appearance on the pumpkin.

17. A method as claimed in claim 16, wherein the base material comprises at least eyes and a mouth which are cut out so that they can be peeled off of the release material and stuck onto a pumpkin to provide a jack-o'-lantern appearance.

18. A method as claimed in claim 16, wherein the base material can be cut by a user of the kit to form at least eyes and a mouth that can be peeled off of the release material and stuck onto a pumpkin to provide a jack-o'-lantern appearance.

19. A method as claimed in claim 16, wherein the base material comprises paper.

20. A method as claimed in claim 16, wherein the base material comprises a polymeric material.

21. A Halloween treat carrier as claimed in claim 1, wherein the Halloween treat carrier further comprises a reflective material.

* * * * *